United States Patent [19]

Wright

[11] 4,159,787

[45] Jul. 3, 1979

[54] CLAMP FOR TUBE DISPENSERS

[76] Inventor: Steven Wright, 22632 Main St., Hayward, Calif. 94541

[21] Appl. No.: 827,178

[22] Filed: Aug. 24, 1977

[51] Int. Cl.[2] ..... F65D 35/20

[52] U.S. Cl. ..... 222/103; 251/10

[58] Field of Search ..... 222/103, 95; 251/4, 251/9, 10

[56] References Cited

U.S. PATENT DOCUMENTS

| | | | |
|---|---|---|---|
| 2,083,603 | 6/1937 | Harwick | 222/95 |
| 2,390,314 | 12/1945 | Massey | 222/103 |
| 3,248,012 | 4/1966 | Adams | 222/95 |
| 3,313,455 | 4/1967 | Kemmer | 222/103 |

FOREIGN PATENT DOCUMENTS

| | | | |
|---|---|---|---|
| 1548613 | 10/1968 | France | 222/103 |

*Primary Examiner*—David A. Scherbel
*Assistant Examiner*—Frederick R. Handren
*Attorney, Agent, or Firm*—Robert W. B. Dickerson

[57] ABSTRACT

A clamp device for effectively evacuating the contents of a flexible tube dispenser is disclosed. The device comprises upper and lower arm portions having a straight trailing side, a forward side having a centrally located curved portion, and opposing arcuate surfaces such that said arm portions are thickest at their centers. End members maintain the separation of the arm portions. In one embodiment, the arm portions are permanently affixed to the end members. In a second embodiment, the lower arm portion is latchably connected to one of the end members.

10 Claims, 8 Drawing Figures

CLAMP FOR TUBE DISPENSERS

BACKGROUND OF THE INVENTION

This invention relates to a clamp device for attachment to flexible tube dispensers such as contain tooth paste, glue, ointment, etc.

Tube dispensers are generally evacuated by direct hand manipulation without auxiliary mechanical aids. This dispensing procedure has proved somewhat frustrating and inefficient, particularly when the tube is almost empty. The present invention is used in conjunction with ordinary hand dispensing technique to provide substantive improvements in the applied use of tube dispensers. Briefly stated, the clamp functions as a movable barrier which segregates the tube into an empty section and a section with substantially full contents. Once attached to the tube end portion, the clamp is manually advanced on the flattened tube surface toward the nozzle orifice as tube slack from evacuation permits.

A variety of devices have been heretofore designed which relate to holders and hand pressure actuated mechanisms for tube dispensers. Such a device is shown in U.S. Pat. No. 2,674,392. It has been found that these devices are not entirely effective in accomplishing their desired function. Furthermore, these implements have relatively complex designs consisting of multiple parts, characterized by levers and pivots. They have generally proved impractical because their annoyances of operation are greater than the moderate disadvantages of using tube dispensers directly. Their high cost has been a further handicap.

SUMMARY OF THE INVENTION

It is the main object of the present invention to overcome the stated and other prior art objections by providing a new clamp for tube dispensers that has genuine utility as an aid to conventional hand dispensing technique.

Another object of the present invention is to provide a clamp that facilitates evacuation of the tube with improved convenience and efficiency.

Yet another object is to provide a clamp that prevents the tube contents from seeping back into the used section.

Still another object is to provide a clamp that functions as a mechanical monitor to guarantee complete evacuation of tube contents.

A further object is to provide a clamp that exerts greater pressure on the center of the flattened tube than toward its edges to facilitate clamp movement.

A still further object is to provide a clamp that preserves the orderly appearance of the tube during use, thereby eliminating crumpled tube eyesores.

Another object is to provide a clamp of molded resilient plastic unitary construction, simple in design, for low cost manufacturing.

A further object is to make an unbreakable, permanent clamp that is reusable.

Other objects and attendant advantages of the present invention will become apparent upon perusal of the following detailed description taken in conjunction with the accompanying drawings, wherein.

Figure 3:
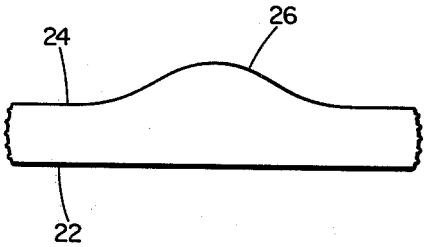
FIG. 3 is a plan view of the clamp device as illustrated in FIG. 1 and FIG. 2.
Figure 4:
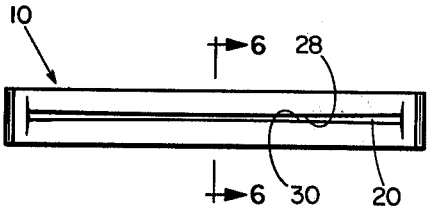
FIG. 4 is a side elevation of the clamp device as shown in FIG. 1.
Figure 6:
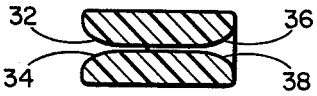
FIG. 6 is an enlarged cross sectional view taken substantially along 6—6 of FIG. 4 and and FIG. 5.
Figure 7:
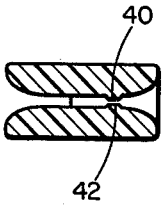
FIG. 7 is a modified view of FIG. 6.

With more particular reference to FIGS. 1, 3, 4, 6 and 7, clamp device 10 of molded resilient plastic unitary construction is comprised of upper arm portion 12, identical lower arm portion 14, end portion 16, and identical end portion 18, thereby delineating slot opening 20. End surfaces 16 and 18 are curved outwardly viewed in plan, and have vertical fluting or serrations. The clamp 10 has one lengthwise straight side 22, and one lenthwise irregular side 24 with symmetrical protruding feature 26 intermediate the ends on arms 12 and 14. In FIG. 3, protruding feature or extension 26 merges into straight sections of said arms 12, 14. In FIG. 4, upper arm clamping surface 28 and lower arm clamping surface 30 are arcuate so the arms have a maximum thickness dimension at the center and a minimum thickness dimension at the ends. Conversely, slot opening 20 has a minimum gap dimension at the center and a maximum gap dimension at the ends. In FIG. 6, the edges of arm clamping surfaces 28 and 30 are rounded at 32 and 34 on irregular side 24, and at 36 and 38 on straight side 22. These rounded edges extend the full lengthwise width of slot opening 20. FIG. 7 is substantially the same as FIG. 6, differing in that arm clamping surfaces 28 and 30 have raised rib floor portions 40 and 42 extending the full lengthwise width of slot opening 20, with said raised floor portions constant in cross sectional shape and size throughout and arcuate in side elevation.

With more particular reference to the foregoing description of clamp device 10, the mode of operation is now set forth. In use, the clamp is held endwise between thumb and forefinger or thumb and second finger, with irregular side 24 facing away from the palm. End surfaces 16 and 18 are curved outwardly and fluted for firm finger holds. Tube dispenser 80 is held in the opposite hand and its tube end inserted into clamp slot opening 20 at protruding feature 26. Arm clamping surfaces 28 and 30 are forced apart and cooperate to exert pressure on the flattened tube thereby effecting a seal barrier which is maintained as the clamp is advanced by jockeying the ends back and forth with a constant forward pressure. The jockeying maneuver requires the lengthwise axis of the clamp to be diagonal to the transverse axis of the tube dispenser. Therefore, slot opening 20 is approximately 5% wider than the flattened width of the largest tube it is designed to accept. Arcuate arm clamping surfaces 28 and 30 exert greater pressure at the center of the flattened tube than toward its edges, thereby effecting a nominal pivot to facilitate the jockeying maneuver by preventing binding between the clamp and the tube edges. Protruding feature 26 on arms 12 and 14 has several advantages. The arms are transversely wider at the protruding feature to strengthen the clamp center. The protruding feature enables the tube end to be inserted easily into slot opening 20 because a minimum forward pressure will spread the arms when they contact the tube end at a single point. The protruding feature, co-acting with irregular side 24 straight arm segments, effects a three-point triangular contact to prevent the flattened tube from folding or buckling if a misdirected force is applied other than along the lengthwise axis of the tube dispenser. When the tube dispenser is almost empty, the protruding feature presses into the conical nozzle front section to expell all contents. Rounded edges 32 and 34 form a self-locating guide for tube end insertion, and distribute the force on the tube as it is swaged flat. Rounded edges 36 and 38 prevent the clamp from binding on the crimped tube end when removed from the empty tube. As a further embodiment, it is advantageous to have raised floor portions 40 and 42 on the arm clamping surfaces to direct the clamping pressure onto a substantially smaller area of the tube thus increasing the pressure thereon.

Figure 1:
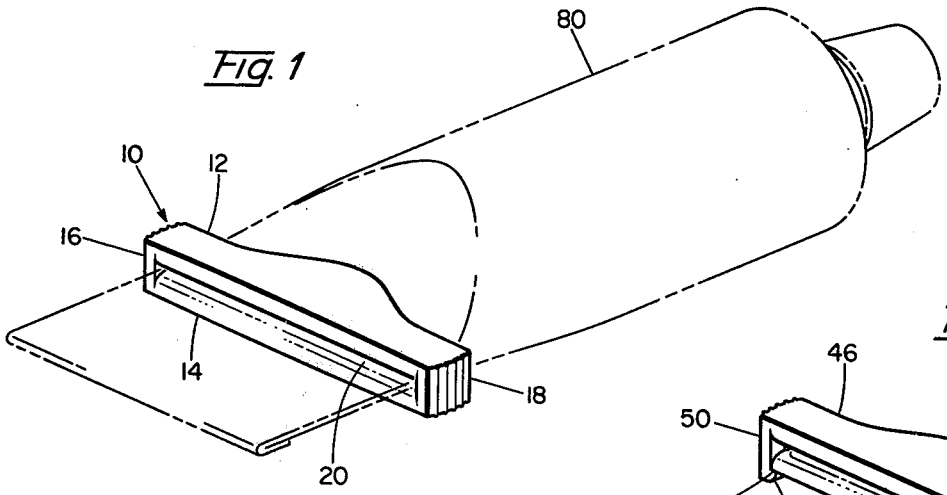
FIG. 1 is a perspective of a clamp device in a preferred embodiment of the invention disposed onto a typical tube dispenser in its operational mode.
Figure 2:
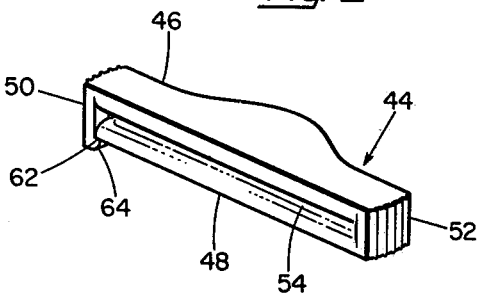
FIG. 2 is a perspective of a modified clamp device in another preferred embodiment, shown in the closed or engaged position.
Figure 5:
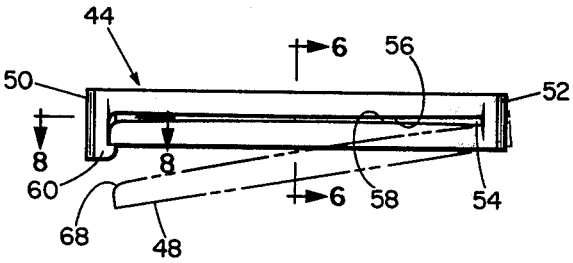
FIG. 5 is a side elevation of the clamp device as shown in FIG. 2.

Referring now to FIGS. 2 and 5, a modified embodiment of the clamp device as shown in FIG. 1 is now described. Modified clamp device 44 of molded resilient plastic unitary construction is comprised of upper arm 46, lower arm 48, upper arm end portion 50 and hinge end portion 52, thereby delineating, in the closed or engaged position, slot opening 54. End surfaces 50 and 52 are curved outwardly viewed in plan, and have vertical fluting or serrations. When observed in the closed position, clamp 44 has one lengthwise straight side 22 and one lengthwise irregular side 24 with symmetrical protruding feature 26 intermediate the ends on arms 46 and 48. FIG. 6 represents the cross sectional view taken along lines 6—6 in both FIGS. 4 and 5. When lower arm 48 is in a closed position, the cross sectional view along line 6—6 is the same in both FIGS. 5 and 6. Similarly, FIG. 7, which shows another embodiment taken along lines 6—6 wherein raised floor portion 40 and 42 extend the full lengthwise width of the slot opening, would be the same in both FIGS. 5 and 6.

Figure 8:
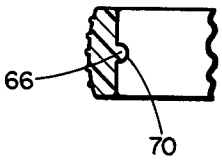
FIG. 8 is an enlarged fragmentary cross sectional view taken substantially along 8—8 of FIG. 5.

In the open position, arms 46 and 48 are naturally biased apart by the resilient spring action effected by integral hinge end portion 52. Upper arm end portion 50 is comprised of hook 60, shelf 62, cam edge 64, and locking rib 66. The terminating end portion of lower arm 48 is comprised of cam edge 68 and locking recess 70. FIG. 8 shows locking rib 66 and locking recess 70 when lower arm 48 is in a closed position.

With more particular reference to the foregoing description of modified clamp device 44, the mode of operation is now set forth. In use, the clamp is attached to the tube end by either of two methods. With the clamp in closed position, it is held endwise between thumb and forefinger or thumb and second finger, with irregular side 24 facing away from the palm. End surfaces 50 and 52 are curved outwardly and fluted for firm finger holds. Tube dispenser 80 is held in the opposite hand and its tube end inserted into clamp slot opening 54 at protruding feature 26, forcing arm clamping surfaces 56 and 58 apart to admit the tube. With clamp in open position, the clamp is held with thumb on upper arm 46 and forefinger on lower arm 48, with irregular side 24 facing away from the palm. The tube dispenser is held in the opposite hand and its tube end placed between the arms, whereupon the arms are squeezed together and locked in the closed position on the tube. When the arms are squeezed together, cam edge 68 on lower arm 48 contacts cam edge 64 on upper arm hook 60, acting to cam upper arm end portion 50 outwardly so lower arm 48 rides past hook 60 and is latchably mated when placed in shear with shelf 62. To prevent transverse movement between the arms in the closed position, locking rib 66 on upper arm end portion 50 engages recess 70 on lower arm 48 placing the arms in transverse shear. Once attached to the tube end, arm clamping surfaces 56 and 58 cooperate to exert pressure on the flattened tube thereby effecting a seal barrier which is maintained as the clamp is advanced by jockeying the ends back and forth with a constant forward pressure. The jockeying maneuver requires the lengthwise axis of the clamp to be diagonal to the transverse axis of the tube dispenser. Therefore, slot opening 54 is approximately 5% wider than the flattened width of the largest tube it is designed to accept. Arcuate arm clamping surfaces 56 and 58 exert greater pressure at the center of the flattened tube than toward its edges, thereby effecting a nominal pivot to facilitate the jockeying maneuver by preventing binding between the clamp and the tube edges. Protruding feature 26 on arms 46 and 48 has several advantages. The arms are transversely wider at the protruding feature to strengthen the clamp center. The protruding feature enables the tube end to be inserted easily into slot opening 54 because a minimum forward pressure will spread the arms when they contact the tube end at a single point. The protruding feature, co-acting with irregular side 24 straight arm segments effects a three-point triangular contact to prevent the flattened tube from folding or buckling if a misdirected force is applied other than along the lengthwise axis of the tube dispenser. When the tube dispenser is almost empty, the protruding feature presses into the conical nozzle front section to expell all contents. Rounded edges 32 and 34 form a self-locating guide for tube end insertion, and distribute the force on the tube as it is swaged flat. Rounded edges 36 and 38 prevent the clamp from binding on the crimped tube end when removed from the empty tube in the closed position. The clamp can also be opened to remove the empty tube by deflecting upper arm end portion 50 outwardly to disengage lower arm 48, wherein the resilient spring-like action acts to separate the arms.

It should be made clear that the clamp device and modification thereof are not generally used to dispense the tube directly. The clamp need only be moved forward on the sealed tube occasionally as slack permits to fulfill its objective function. The contents are dispensed simply by squeezing the unsealed tube in the conventional manner.

From the foregoing, it is submitted that a novel low cost clamp device and modification thereof have been provided so that the objects of the invention are achieved. It should be emphasized, however, that the particular embodiments of the invention which are specifically disclosed herein are intended as merely illustrative and not restrictive of the present invention, with other modifications and embodiments thereof being embodied within the spirit and scope of the present invention as defined by the appended claims.

What is claimed is:

1. A clamp device for effectively evacuating the contents of a flexible tube dispenser comprising:

A. upper and lower arm portions of sufficient length to accept the width of a tube dispenser, said arm portions being further characterized as having:

1. a straight trailing side;

2. a forward side having a centrally located protruding curved portion which merges into straight sections at the ends of said arm portions;
3. opposing lengthwise arcuate surfaces such that said arm portions are thickest at their centers;
4. opposing rounded lengthwise side edges on said trailing and forward sides; and B. end members being connected to said upper and lower arm portions for maintaining separation between said upper and lower arm portions said separation defining a gap therebetween to accept said flexible tube dispenser.

2. The device of claim 1 wherein said end members are curved outwardly and include vertical fluting.

3. The device of claim 1 wherein at least one of said upper and lower arm portions possess raised rib on said arcuate surface.

4. The device of claim 1 wherein said gap between the upper and lower arm portions is designed to be approximately 5% wider than the flattened width of the flexible tube dispenser.

5. A clamp device for effectively evacuating the contents of a flexible tube dispenser comprising:

A. upper and lower arm portions of sufficient length to accept the width of a tube dispenser, said arm portions being further characterized as having:
1. a straight trailing side;
2. a forward side having a centrally located protruding curved portion which merges into straight sections at the ends of said arm portions;
3. opposing lengthwise arcuate surfaces such that said arm portions are thickest at their centers;
4. opposing rounded lengthwise side edges on said trailing and forward sides; and B. a first end member being fixed to said upper and lower arm portions and being further characterized as maintaining separation between arm portions such as to define a gap therebetween to accept said flexible tube dispenser; and C. a second end member fixed to one of said arm portions and having means for releasably accepting the other of said arm portions.

6. The device of claim 5 wherein said accepting means include a shelf portion on said second end member for accepting said other arm portion in shear.

7. The device of claim 6 wherein one of the said second end member and other arm portion includes a locking rib and the other includes a rib receiving recess.

8. The device of claim 5 wherein said end members are curved outwardly and have vertical fluting.

9. The device of claim 5 wherein at least one of said upper and lower arm portions possess a raised rib on said arcuate surface.

10. The device of claim 5 wherein said gap between the upper and lower arm portions is designed to be approximately 5% wider than the flattened width of the flexible tube dispenser.

* * * * *